US006526709B1

(12) United States Patent
Jacobsen

(10) Patent No.: US 6,526,709 B1
(45) Date of Patent: Mar. 4, 2003

(54) REPLACEMENT WINDOW INSTALLATION AND FLASHING SYSTEM

(76) Inventor: Rodney Allen Jacobsen, 1004 Down River Ct., Roseville, CA (US) 95747

( * ) Notice: Subject to any disclaimer, the term of this patent is extended or adjusted under 35 U.S.C. 154(b) by 0 days.

(21) Appl. No.: 10/040,331

(22) Filed: Jan. 9, 2002

(51) Int. Cl.[7] ..... E06B 1/04; E06B 3/30; E06B 3/26; E06B 3/28

(52) U.S. Cl. ..... 52/211; 52/212; 52/204.53; 52/204.54; 52/202; 52/203

(58) Field of Search ..... 52/212, 217, 204.54, 52/204.56, 208, 209, 204.53, 211, 202, 203, 775, 766

(56) References Cited

U.S. PATENT DOCUMENTS

| | | | | | |
|---|---|---|---|---|---|
| 3,126,986 | A | * | 3/1964 | Madl | 52/210 |
| 3,380,210 | A | * | 4/1968 | Neal | 52/235 |
| 3,455,080 | A | * | 7/1969 | Meadows | 52/204.597 |
| 3,858,377 | A | * | 1/1975 | Browne et al. | 52/463 |
| 3,964,225 | A | * | 6/1976 | Yoshida | 52/766 |
| 4,625,479 | A | * | 12/1986 | Giguere | 52/202 |
| 4,702,050 | A | * | 10/1987 | Giguere | 52/202 |
| 4,873,803 | A | * | 10/1989 | Rundo | 52/202 |
| 5,503,700 | A | * | 4/1996 | Dupuy | 156/228 |
| 6,161,344 | A | * | 12/2000 | Blanchett | 52/204.2 |
| 6,263,632 | B1 | * | 7/2001 | Cadorette | |

FOREIGN PATENT DOCUMENTS

| | | | |
|---|---|---|---|
| DE | 3441-444 A | * | 11/1984 |
| GB | 2 196 045 A | * | 4/1988 |
| JP | 0087491 | * | 4/1991 |
| NL | 6400239 | * | 7/1965 |

* cited by examiner

*Primary Examiner*—Carl D. Friedman
*Assistant Examiner*—Kevin McDermott
(74) *Attorney, Agent, or Firm*—Keusey, Tutunjian & Bitetto, P.C.

(57) ABSTRACT

A Replacement Window Installation and Flashing System consisting mainly of an Interior Jam Liner and an Exterior Cap. The Interior Jam Liner is of an elongated extruded shape; it is designed for installation around the perimeter of a window opening that has been prepared by collapsing and removing the original window frame. After being cut to the desired length the Interior Jam Liner is installed on all 4 sides of the window opening so that a vertical member on the Interior Jam Liner is positioned in the area that was previously occupied by the original windows nailing fin. An opposed vertical member at the back of the Interior Jam Liner forms a stop with which to set a new replacement window against. After the new replacement window is positioned against this stop and fastened into place, the Exterior Cap, also an elongated extruded shape, is cut to length, assembled as a rectangle, and mated with the Interior Jam Liner by a male-female self-securing connection. The original "new construction" type of seal is retained and rainwater is channeled away by the Interior Jam Liner.

17 Claims, 8 Drawing Sheets

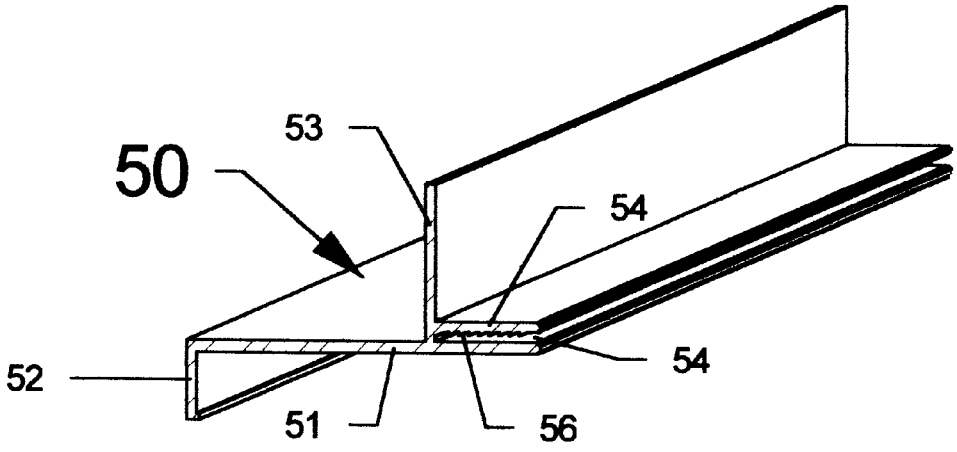
Fig. # 6
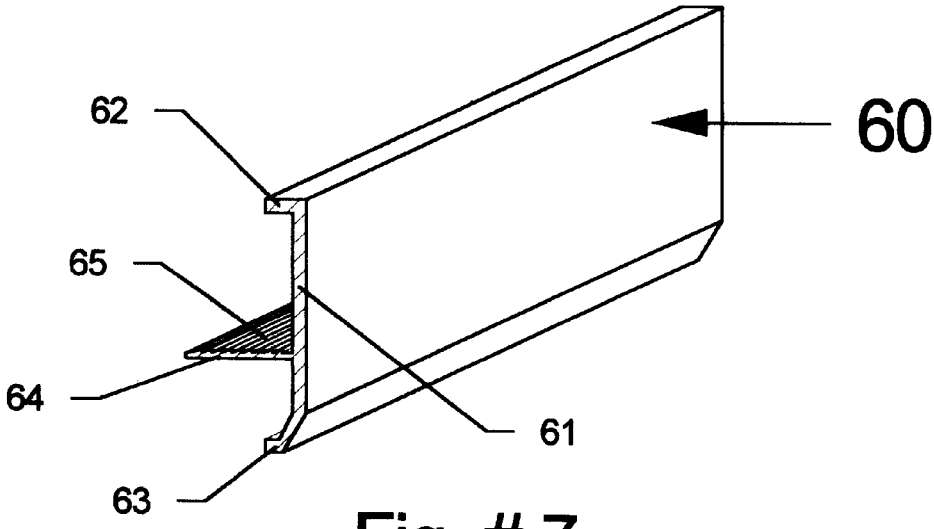
Fig. # 7

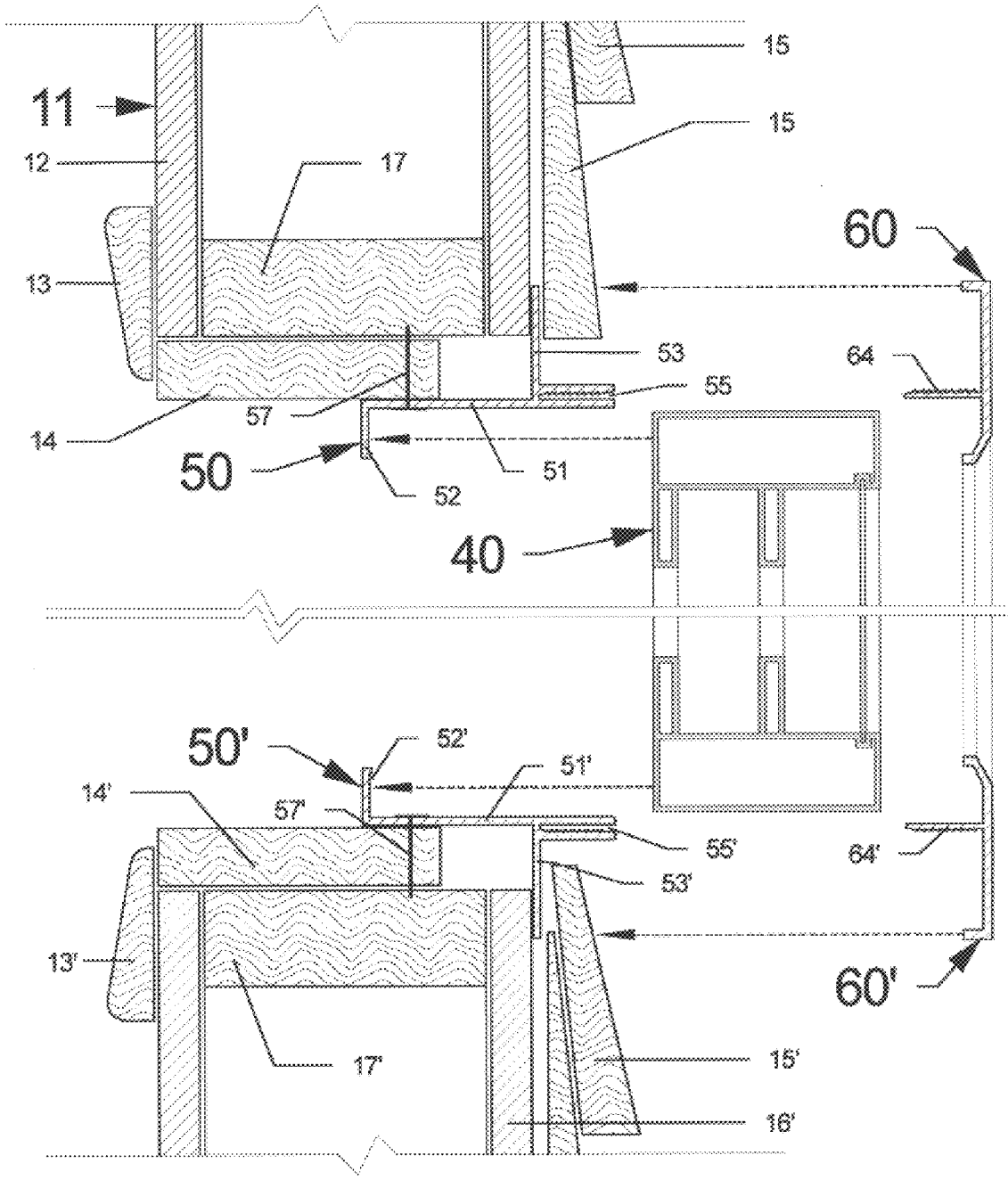
Fig. # 8

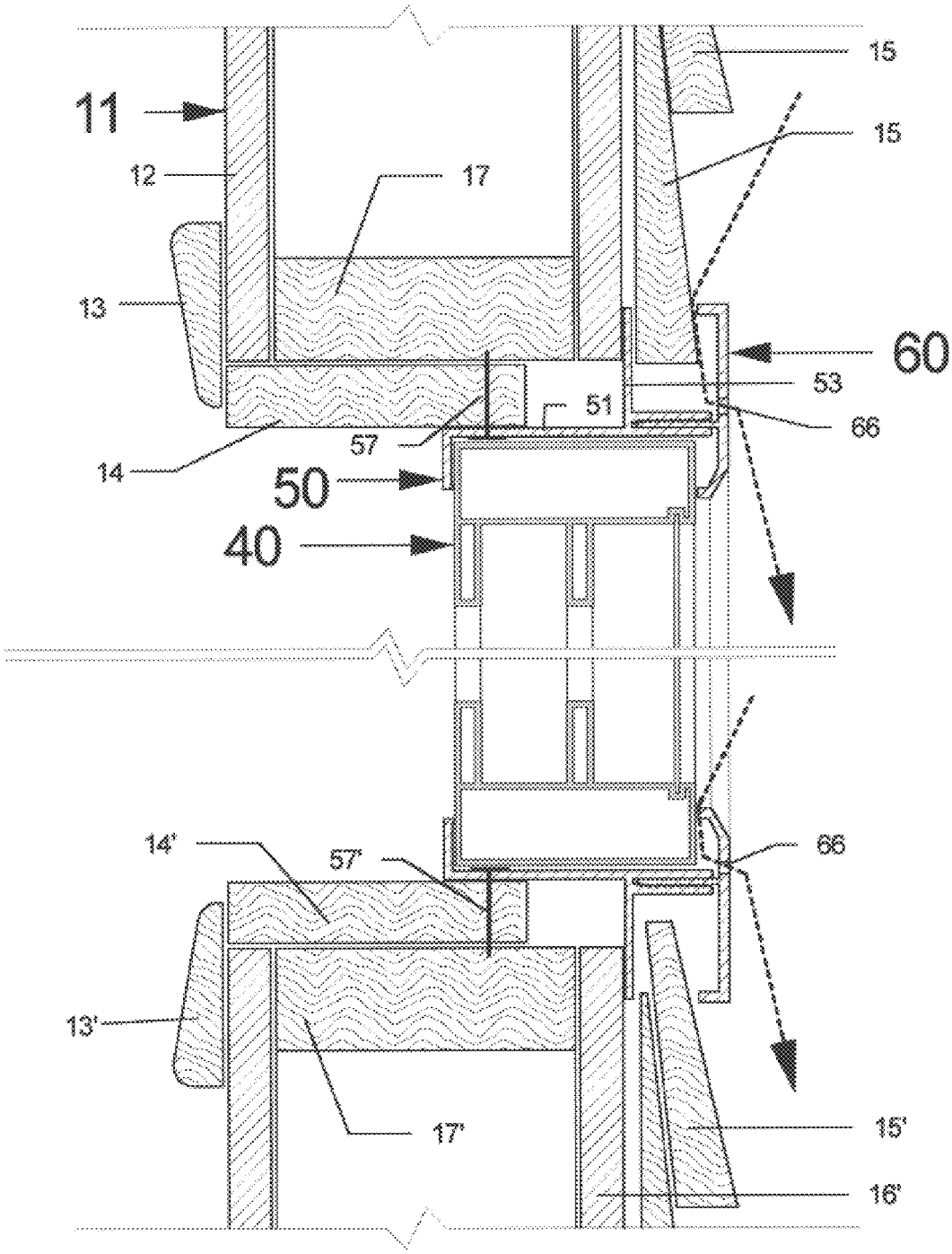
Fig. # 9

REPLACEMENT WINDOW INSTALLATION AND FLASHING SYSTEM

FIELD OF THE INVENTION

The present Invention relates generally to window frames and flanges.

BACKGROUND OF THE INVENTION

Vinyl Replacement windows for residential and commercial buildings are becoming increasingly popular. Among their many benefits they provide increased comfort, updated looks, and energy efficiency. Installation of these windows, however, if not done properly, can result in severe damage caused by water seepage into the interior walls of the structure. Current installation methods include, but are not limited to the following:

Method A, the exterior siding around the perimeter of the window frame is cut away to expose the nailing fin that holds the window in place. This old window is then removed and a new construction style (nail fin frame) window of the same width and height is installed. A filler board is used to replace the cut away siding and 1×4 trim boards are typically installed to hide this cut away area. (Prior art FIG. 2).

Method B, leaving the old aluminum window's main frame in place, the new window is sized to fit inside of the old frame and is sealed in place with caulking between the old frame and a flush fin on the new window. (Prior art FIG. 3).

Method C, after complete removal of the old aluminum window, the new window is sized to fit inside of the sheetrock and framing and is sealed in place with caulking between the exterior siding and a flush fin on the new window. (Prior art FIG. 4).

The preceding methods as well as most others, rely on caulking as a primary seal to prevent water from seeping into the structure. Deterioration of the caulking, cracks in the adjacent siding, improper caulking application and other factors can lead to failure of this seal and water seepage into the walls of the structure.

The present invention is designed to provide a "new construction" type of window flashing, eliminate the need for caulking as a primary seal and prepare the opening for installation of a replacement window.

DESCRIPTION OF PRIOR ART

FIG. 1 is a sectional view showing the most typical new construction installation of a conventional aluminum window frame 10 attached to a wall 11. Wall 11 includes on its interior, a drywall 12 and a casing 13. A jam liner 14 is attached to the perimeter of the window opening. Sidings 15 are attached in front of a subsiding 1 6, which is attached to wall framing 17. Window frame 10 includes a vertical nailing flange 18 between siding 15 and subsiding 16, and a horizontal member 19 extending forwardly from the lower edge of nailing flange 18. Similar items at the lower part of the window are indicated by the symbol (') next to the number. Dimension D1 is the distance between the lower horizontal edge of siding 15 directly above horizontal member 19 and the upper horizontal edge of siding 15' directly below horizontal member 19'. Dimension D2 is the overall height of window frame 10 from the upper edge of nailing flange 18 to the lower edge of nailing flange 18'. Because siding 15 and 15' overlap nailing flange 18 and 18', dimension D1 is always smaller than dimension D2. It is this overlapping of siding 15 on nailing flange 18 and 18' that makes this "new construction" type of installation waterproof. Rain water, as indicated by the dashed arrow, hitting horizontal member 19 can seep under siding 15, but is prevented by nailing flange 18 from entering wall 11.

FIG. 2 is a sectional view showing a replacement window frame 20 installed into wall 11. The original aluminum window frame has been removed by cutting away part of siding 15 and exposing the windows nailing flange. Window frame 20 has a nailing flange 21 extending vertically from its upper and lower horizontal edges for the purpose of attaching window frame 20 to wall 11 against subsiding 16. A filler board 22 is cut to size and installed over nailing flange 21 to replace siding 15 that was removed previously. Trim board 23 is installed over filler board 22 and siding 15 to hide any uneven cuts or gaps. Caulking 24 is applied to a joint between trim board 23 and siding 15 to prevent water entry.

However, caulking 24 is sometimes improperly applied or fails because of movement between trim board 23 and siding 15. Also, by cutting away siding 15 to facilitate the removal of the original window frame 10 and the installation of the replacement window frame 20, siding 15 is not able to overlap nailing flange 21 and form a "new construction" type of seal. These conditions will result in a path for rainwater to seep into the interior of the structure as indicated by the dashed arrow.

FIG. 3 is a sectional view showing a replacement window frame 30 installed into wall 11 over aluminum window frame 10. Window frame 30 has been sized to fit within the interior dimensions of window frame 10. A flush fin 31 extends vertically from the outer edge of window frame 30 to cover the exterior of window frame 10. Caulking 32 is applied to a joint between flush fin 31 and aluminum window frame 10 to prevent water entry.

However, caulking 32 is sometimes improperly applied or fails because of movement between flush fin 31 and window frame 10. These conditions will result in a path for rainwater to seep into the interior of the structure as indicated by the dashed arrow.

FIG. 4 is a sectional view showing another common replacement method. With this method the original aluminum window frame has been collapsed and removed leaving the siding 15 intact. Window frame 30 is sized to fit between upper jam liner 14 and lower jam liner 14'. Caulking 32 is applied to a joint between flush fin 31 and siding 15 to prevent water entry.

Again, caulking 32 is sometimes improperly applied or fails because of movement between flush fin 31 and siding 15. These conditions will result in a path for rainwater to seep into the interior of the structure as indicated by the dashed arrow. FIG. 5 is a sectional view showing a replacement window frame 40 installed into wall 11 using a waterproof window flange 41 (U.S. Pat. No. 5,996,293). Frame 40 is a "block" style frame, indicating that it has no vertical nailing flange as with frame 20, or vertical flush fin as with frame 30. Flange 41 consists of a vertical member 42, a horizontal member 43, a channel 44 for receiving a right angle comer key for aligning adjoining flanges, and a borehole 45 to receive a screw for securing adjoining flanges together. In the detailed description (U.S. Pat. No. 5,996, 293) of flange 41 it is indicated that in its preferred embodiment flange 41 can be cut to any desired length, usually with angled ends for forming a rectangular frame. Each corner of the rectangular frame receives a comer key in channel 44 and a screw in bore hole 45 to hold the rectangular frame together. Further description indicates that this frame is then installed around the window opening without cutting siding 15. Member 42 is installed between siding 15 and subsiding 16 with the top surface of member 43 against the bottom of siding 15. The overlapping of siding 15 on member 42 is what gives flange 41 its waterproof ness. The problem with flange 41 is that in its preferred embodiment as an assembled rectangular frame, it is not possible to install this frame behind siding 15 without cutting away siding 15. Dimension D1 (the distance between the lower horizontal edge of siding 15 directly above horizontal member 43 and the upper horizontal edge of siding 15' directly below horizontal member 43') is always smaller than Dimension D2 (the overall height of the assembled rectangular frame from the upper edge of member 42 to the lower edge of member 42'). Cutting away siding 15 to allow for installation of the assembled frame would result in a potential water seepage problem similar to that of FIG. 2.

SUMMARY OF PRESENT INVENTION

The Replacement Window Installation and Flashing System consists mainly of an Interior Jam Liner and an Exterior Cap. The Interior Jam Liner is of an elongated extruded shape. It is designed for installation around the perimeter of a window opening that has been prepared by collapsing and removing the original window frame. After being cut to the desired length the Interior Jam Liner is installed on all 4 sides of the window opening so that a vertical member on the Interior Jam Liner is positioned in the area that was previously occupied by the original windows nailing fin. An opposed vertical member at the back of the Interior Jam Liner now forms a stop with which to set a new replacement window against. After the new replacement window is positioned against this stop and fastened into place, the Exterior Cap (also an elongated extruded shape) is cut to length, assembled as a rectangle, and mated with the Interior Jam Liner by a male-female self-securing connection. The original "new construction" type of seal is retained and rainwater is channeled away by the Interior Jam Liner.

BRIEF DESCRIPTION OF THE DRAWINGS

FIG. #1 is a sectional view of a prior art aluminum window installed in a wall.

FIG. #2 is a sectional view of prior art replacement window installation method A.

Figure 1:
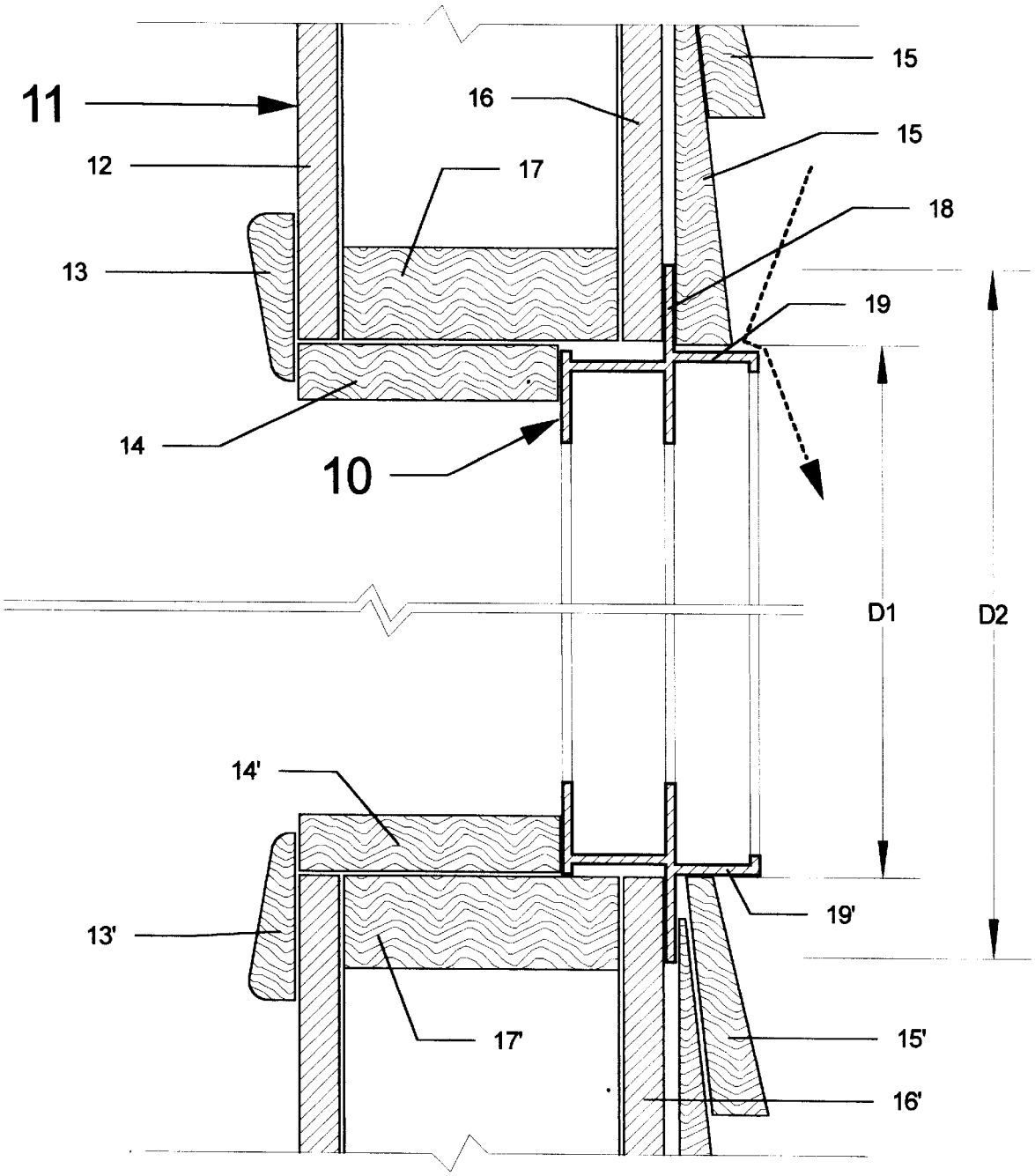
Fig. 1 Prior Art
Figure 2:
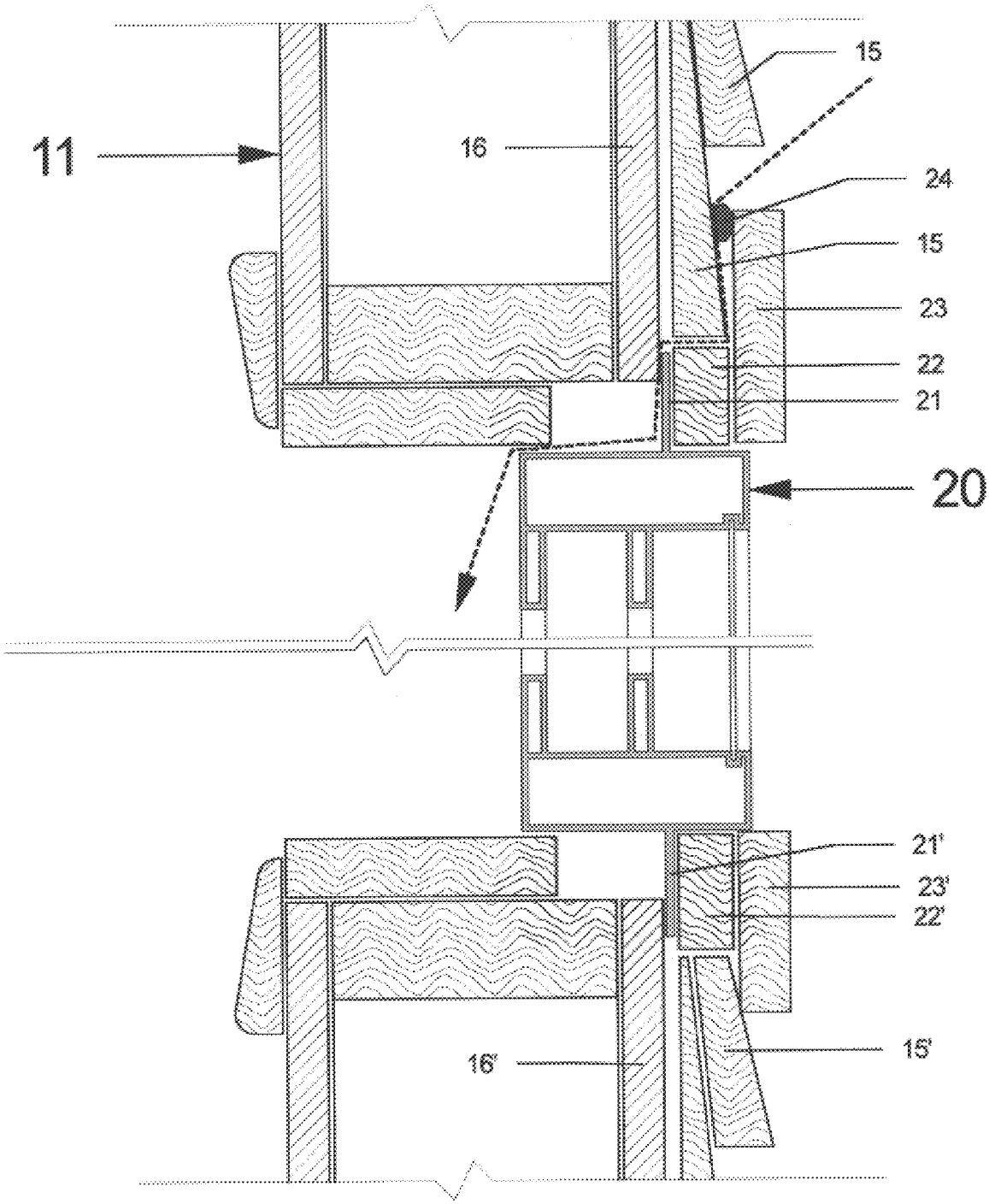
Fig. 2 Prior Art
Figure 3:
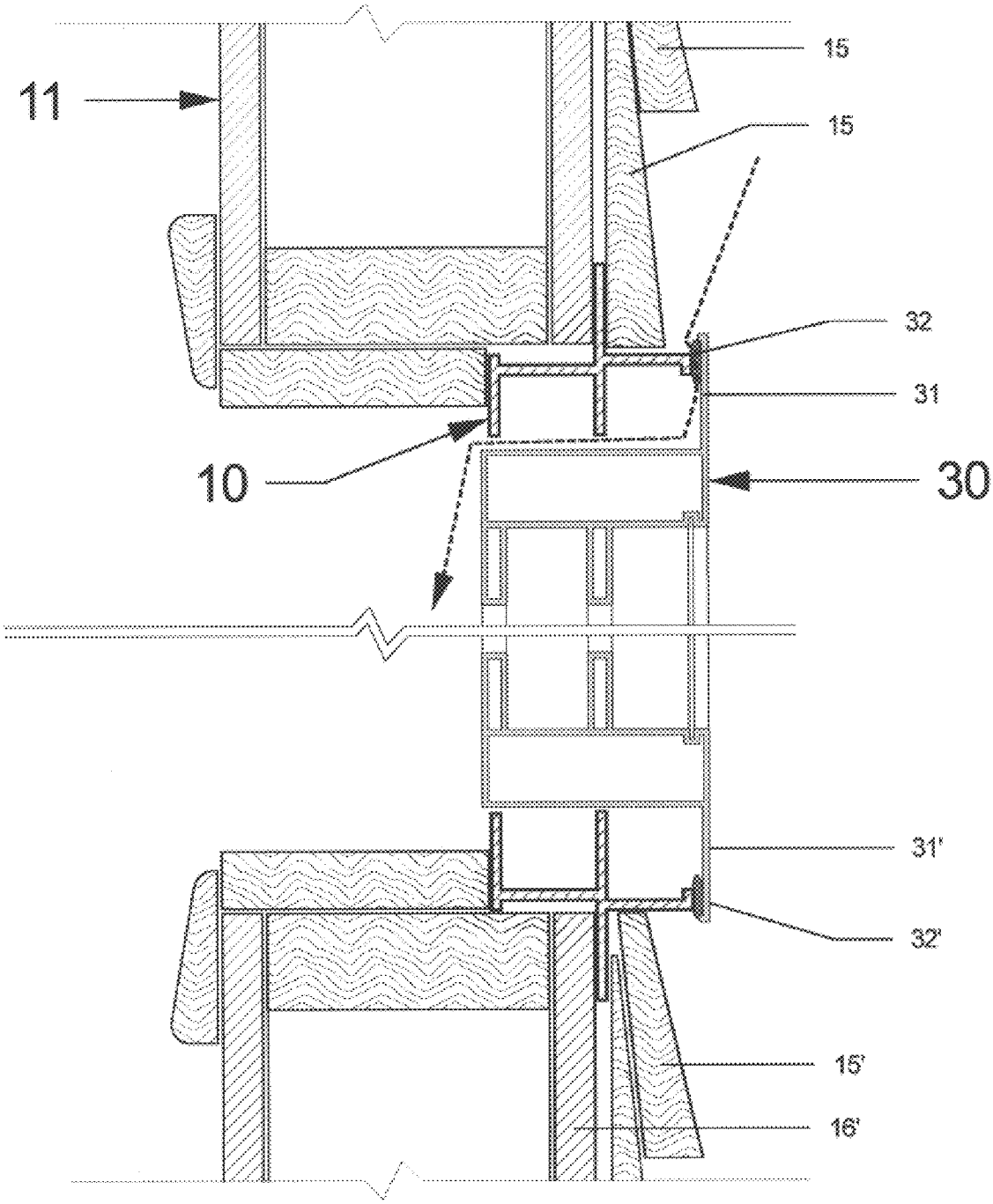
Fig. 3 Prior Art
Figure 4:
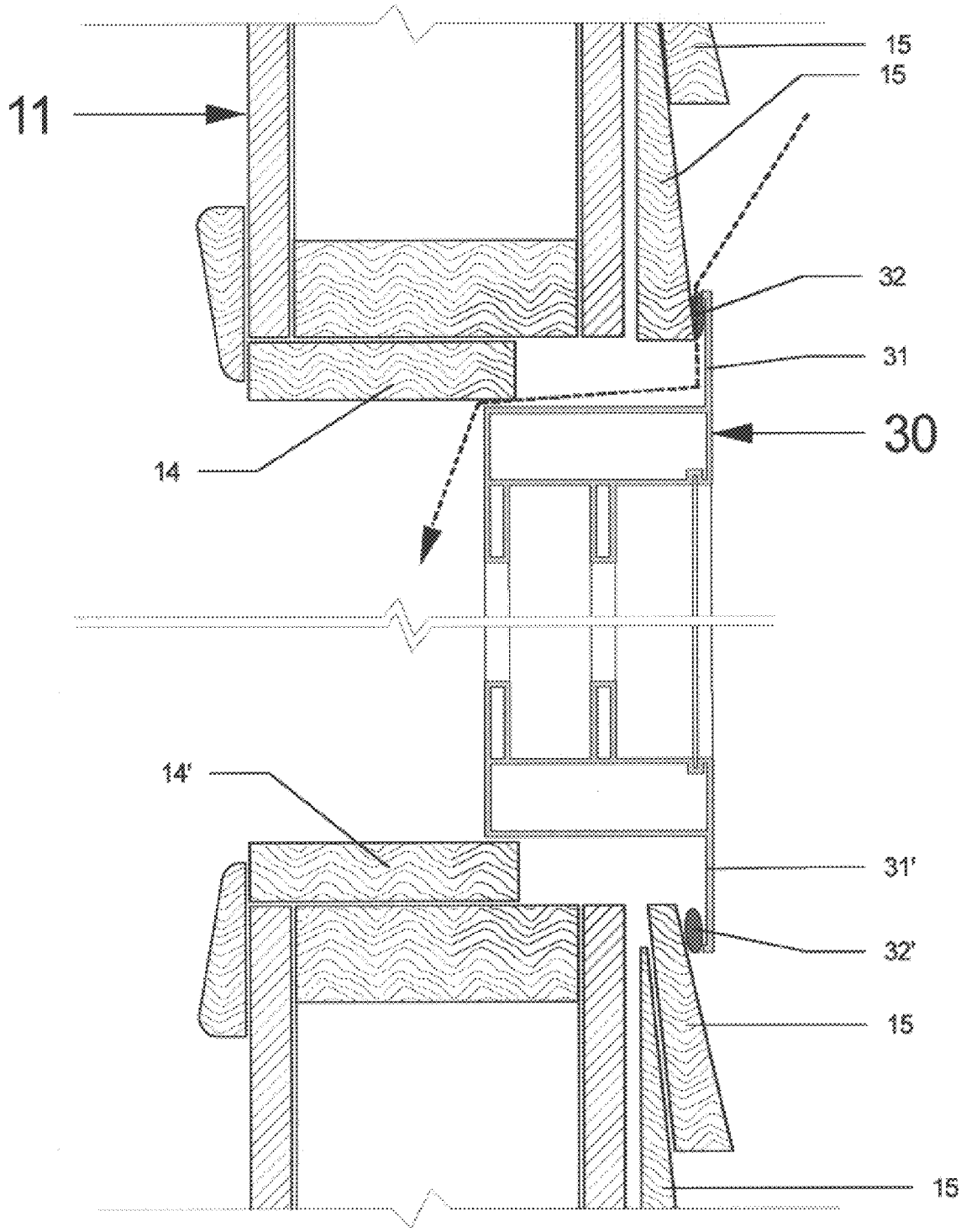
Fig. 4 Prior Art
Figure 5:
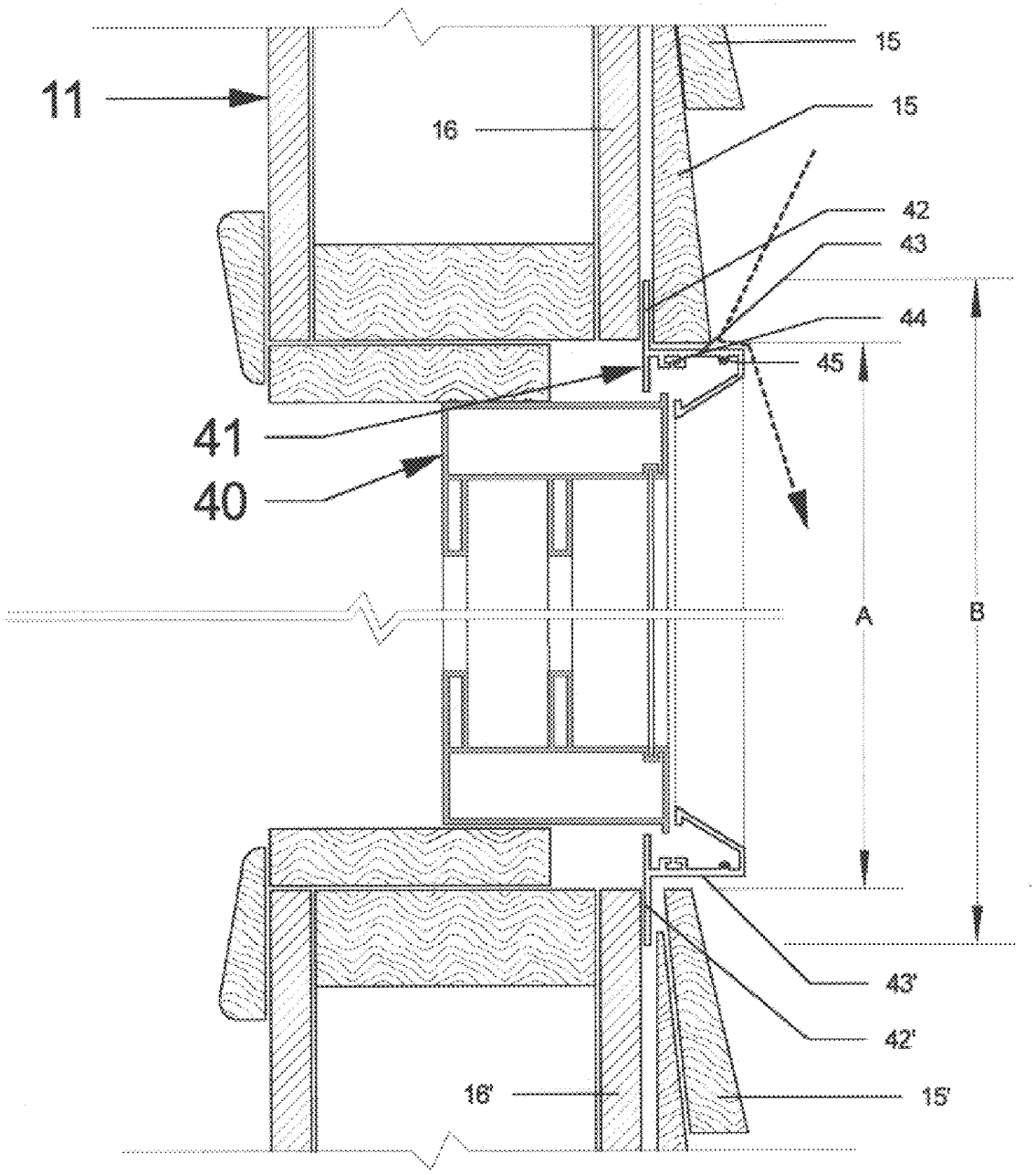
Fig. 5 Prior Art

FIG. #3 is a sectional view of prior art replacement window installation method B.

FIG. #4 is a sectional view of prior art replacement window installation method C.

FIG. #5 is a sectional view of prior art waterproof window flange (U.S. Pat. No. 5,996,293).

FIG. #6 is an end perspective view of the Interior Jam Liner.

FIG. #7 is an perspective view of the Exterior Cap.

FIG. #8 is a sectional exploded view of the present invention installed in a wall.

FIG. #9 is a sectional view of the present invention installed in a wall.

DETAILED DESCRIPTION OF THE INVENTION

A preferred embodiment of the Replacement Window Installation and Flashing System is shown in FIG. #6 and FIG. #7. Please note that the pieces described below are designed for installation on all 4 sides of a window opening in a wall. Unless otherwise noted, the following descriptions, in reference to the orientation of the various members of the pieces, will refer only to the pieces used at the top of the window opening since this is the most likely entry point for water.

FIG. #6 is an end perspective view of the Interior Jam Liner 50. It is an elongated extruded shape consisting of a horizontal first member 51, a vertical second member 52 extending downwards from the end of first member 51, a vertical third member 53 extending upwards from an intermediate position on first member 51, and a horizontal forth member 54 extending forward from an intermediate position on vertical third member 53. A channel 55 is formed by a predetermined offset between horizontal forth member 54 and the adjacent portion of horizontal member 51. This channel is designed to receive the Exterior Cap. Horizontal forth member 54 also includes on its lower surface, saw tooth shaped ridges 56 for gripping the Exterior Cap.

FIG. #7 is an end perspective view of the Exterior Cap 60. It is an elongated extruded shape consisting of a vertical first member 61, a horizontal second member 62 extending backwards from the upper edge of vertical first member 61, a horizontal third member 63 extending backwards from the lower edge of vertical first member 61, and a horizontal forth member 64 extending backwards from an intermediate position on vertical first member 61. Horizontal forth member 64 also includes on its upper surface saw tooth shaped ridges 65 for gripping the Interior Jam Liner 50.

FIG. #8 is an exploded sectional view showing the Replacement Window Installation and Flashing System, as it would be assembled to install a replacement window 40 into wall 11. After the original aluminum window frame has been collapsed and removed, the Interior Jam Liner 50 would be cut to the necessary length to fit across the upper portion of the window opening. Interior Jam Liner 50 would then be installed so that vertical third member 53 is inserted between siding 15 and subsiding 16, and that horizontal first member 51 is fastened by nail 57 to liner 14. Interior Jam Liner 50' would be installed in the exact same manor at the lower portion of the window opening. Two additional lengths of the Interior Jam Liner extrusion would be cut for the sides of the window opening and installed to form a completed rectangular liner. Replacement window 40 is then installed from the exterior of wall 11 into the Interior Jam Liner 50 until replacement window 40 comes into contact with vertical second member 52. The Exterior Cap 60 is then miter cut at a 45 degree angle at the proper length for all 4 sides of the window opening and assembled as a rectangle by either mechanically fastening the mitered comers with screws or comer keys or, with the proper equipment, thermal fusion welding the comers. The assembled Exterior Cap is then installed against the exterior of replacement window 40 by inserting horizontal forth member 64 into channel 55 on the Interior Jam Liner 50.

FIG. #9 is a sectional view of the completed Replacement Window Installation and Flashing System containing a replacement window 40 installed into a wall 11. Rain water as indicated by the dashed arrow hitting siding 15 can seep around the upper edge of Exterior Cap 60 but is prevented from entering wall 11 by vertical third member 53. The water is then channeled around the assembly or is expelled to the exterior through drain holes 66 in the face of Exterior Cap 60. This system eliminates the need for caulking as a primary seal and prevents water from entering the wall by reestablishing the new construction type of seal that was present with the original window.

What I claim as my invention is:

1. A Replacement Window Installation and Flashing System for installing a replacement window in a wall having a window jam and siding disposed over subsiding, the window jam having a jam liner, said system comprising:

an interior jam liner including:

an interior jam liner horizontal first member for contacting the jam liner of the window jam, an interior jam liner vertical third member extending upwards from an intermediate position on said interior jam liner horizontal first member, said interior jam liner vertical third member for disposing between the siding and the subsiding, and an interior jam liner horizontal fourth member extending forward from an intermediate position on said interior jam liner vertical third member, wherein a channel is formed by a predetermined offset between said interior jam liner horizontal fourth member and an adjacent portion of said interior jam liner horizontal first member; and an exterior cap including, an exterior cap vertical first member, an exterior cap horizontal fourth member extending backwards from an intermediate position on said exterior cap vertical first member, said exterior cap horizontal fourth member for inserting in said channel on said interior jam liner so that said exterior cap partially covers the replacement window and the siding to prevent water from seeping into the wall; and wherein said interior jam liner horizontal first member connects to the jam liner of the window jam.

2. The system of claim 1, wherein said interior jam liner further includes an interior jam liner vertical second member extending downwards from an end of said interior jam liner horizontal first member that is opposite said channel, said interior jam liner vertical second member for contacting the replacement window.

3. The system of claim 2, wherein said interior jam liner vertical second member contacts the replacement window so as to prevent a rearward movement of the replacement window.

4. The system of claim 1, wherein said exterior cap further includes an exterior cap horizontal second member extending backwards from an upper edge of said exterior cap vertical first member, said exterior cap horizontal second member for contacting the siding.

5. The system of claim 1, wherein said exterior cap further includes an exterior cap horizontal third member extending backwards from a lower edge of said exterior cap vertical first member, said exterior cap horizontal third member for contacting the replacement window.

6. The system of claim 1, wherein said exterior cap further includes drain holes for routing water away from an interior of the wall.

7. The system of claim 1, wherein said channel includes saw toothed shaped ridges for gripping said exterior cap horizontal fourth member.

8. The system of claim 7, wherein said saw toothed shaped ridges are disposed on said interior jam liner horizontal fourth member.

9. The system of claim 1, wherein said exterior cap horizontal fourth member includes saw toothed ridges for gripping an inner portion of said channel.

10. A Replacement Window Installation and Flashing System for installing a replacement window in a wall having a window jam and siding disposed over subsiding, the window jam having a jam liner, said system comprising:

an interior jam liner including:

an interior jam liner horizontal first member for contacting the jam liner of the window jam, an interior jam liner vertical third member extending upwards from an intermediate position on said interior jam liner horizontal first member, said interior jam liner vertical third member for disposing between the siding and the subsiding, and an interior jam liner horizontal fourth member extending forward from an intermediate position on said interior jam liner vertical third member, wherein a channel is formed by a predetermined offset between said interior jam liner horizontal fourth member and an adjacent portion of said interior jam liner horizontal first member; and an exterior cap including, an exterior cap vertical first member, an exterior cap horizontal fourth member extending backwards from an intermediate position on said exterior cap vertical first member, said exterior cap horizontal fourth member for inserting in said channel on said interior jam liner so that said exterior cap partially covers the replacement window and the siding to prevent water from seeping into the wall; and wherein said interior jam liner further includes an interior jam liner vertical second member extending downwards from an end of said interior jam liner horizontal first member that is opposite said channel, said interior jam liner vertical second member for contacting the replacement window so as to prevent a rearward movement of the replacement window.

11. The system of claim 10, wherein said exterior cap further includes an exterior cap horizontal second member extending backwards from an upper edge of said exterior cap vertical first member, said exterior cap horizontal second member for contacting the siding.

12. The system of claim 10, wherein said exterior cap further includes an exterior cap horizontal third member extending backwards from a lower edge of said exterior cap vertical first member, said exterior cap horizontal third member for contacting the replacement window.

13. The system of claim 10, wherein said interior jam liner horizontal first member connects to the jam liner of the window jam.

14. The system of claim 10, wherein said exterior cap further includes drain holes for routing water away from an interior of the wall.

15. The system of claim 10, wherein said channel includes saw toothed shaped ridges for gripping said exterior cap horizontal fourth member.

16. The system of claim 15, wherein said saw toothed shaped ridges are disposed on said interior jam liner horizontal fourth member.

17. The system of claim 10, wherein said exterior cap horizontal fourth member includes saw toothed ridges for gripping an inner portion of said channel.

* * * * *